US006074458A

United States Patent [19]

Bittner et al.

[11] Patent Number: 6,074,458

[45] **Date of Patent: *Jun. 13, 2000**

[54] METHOD AND APPARATUS FOR SEPARATION OF UNBURNED CARBON FROM FLYASH

[75] Inventors: James D. Bittner, Westford; Thomas M. Dunn, Wilmington; Frank J. Hrach, Jr., Mansfield, all of Mass.

[73] Assignee: Separation Technologies, Inc., Needham, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,157

[22] Filed: Feb. 24, 1997

[51] Int. Cl.[7] ..... B03C 3/014

[52] U.S. Cl. ..... 95/60; 95/65; 95/66; 95/71; 95/72; 96/17; 96/52; 96/57; 96/74; 110/216; 110/345; 209/127.2; 209/127.4

[58] Field of Search ..... 95/60, 71, 72, 95/64–66, 73; 96/52, 53, 55, 57, 74, 17; 209/2, 3, 11, 127.1–127.4, 128; 110/216, 345

[56] References Cited

U.S. PATENT DOCUMENTS

| | | | |
|---|---|---|---|
| 2,758,666 | 8/1956 | Prentiss | 96/17 X |
| 2,776,725 | 1/1957 | Wood | 96/17 |
| 3,941,685 | 3/1976 | Singewald et al. | 209/127.4 X |
| 4,297,207 | 10/1981 | Singewald et al. | 209/127.4 X |
| 4,482,351 | 11/1984 | Kitazawa et al. | 209/127.2 |
| 4,767,506 | 8/1988 | Fricke | 209/127.4 |
| 4,839,032 | 6/1989 | Whitlock | 209/3 |
| 4,874,507 | 10/1989 | Whitlock | 209/11 |
| 5,251,762 | 10/1993 | Taylor et al. | 209/127.4 |
| 5,299,692 | 4/1994 | Nelson et al. | 209/2 |
| 5,358,119 | 10/1994 | Stahl et al. | 209/11 |
| 5,449,390 | 9/1995 | Duncan et al. | 95/72 X |
| 5,513,755 | 5/1996 | Heavilon et al. | 209/2 |
| 5,562,755 | 10/1996 | Fricke et al. | 209/127.4 X |
| 5,819,946 | 10/1998 | Whitlock et al. | 209/127.1 |
| 5,829,598 | 11/1998 | Whitlock | 209/128 |

FOREIGN PATENT DOCUMENTS

| | | |
|---|---|---|
| 57 171454 | 10/1982 | Japan . |
| 59 049858 | 3/1984 | Japan . |

OTHER PUBLICATIONS

D.R. Whitlock: "Electrostatic Separation of Unburned Carbon from Fly Ash" Proceedings Tenth Int. Ash Use Symposium, vol. 2, 1993, pp. 70–1–70–2, XP002063618.

*Primary Examiner*—Richard L. Chiesa
*Attorney, Agent, or Firm*—Wolf, Greenfield & Sacks, P.C.

[57] ABSTRACT

Apparatus and method for separating carbon particles from flyash includes one of increasing a relative humidity of the flyash or decreasing the relative humidity of the flyash to within an optimum humidity range, and introducing the flyash within the optimum humidity range into a triboelectric separator so as to triboelectrically charge the carbon particles and the flyash and so as to electrostatically separate the charged carbon particles from the charged flyash.

23 Claims, 12 Drawing Sheets

| | radius for pure water | | | | | |
|---|---|---|---|---|---|---|
| RH % | meters | microns | Angstroms | | | |
| 100 | flat | flat | flat | | Radius for saturated salts | |
| 99.9999 | 0.001078 | 1077.602 | 10776016 | | NaCl (75) | NaI (50) | CaCl2 (33 |
| 99.999 | 0.000108 | 107.7597 | 1077597 | | Angstroms | | |
| 99.99 | 1.08E-05 | 10.77548 | 107754.8 | | | | |
| 99.9 | 1.08E-06 | 1.077063 | 10770.63 | | | | |
| 99 | 1.07E-07 | 0.107221 | 1072.205 | | | | |
| 90 | 1.02E-08 | 0.010228 | 102.2776 | | | | |
| 75 | 3.75E-09 | 0.003746 | 37.45809 | | flat | | |
| 50 | 1.55E-09 | 0.001555 | 15.54651 | | 26.57694 | flat | |
| 40 | 1.18E-09 | 0.001176 | 11.76048 | | 17.14266 | 48.29188 | |
| 30 | 8.95E-10 | 0.000895 | 8.950386 | | 11.76048 | 21.0953 | 113.0627 |
| 25 | 7.77E-10 | 0.000777 | 7.773257 | | 9.808758 | 15.54651 | 38.81408 |
| 20 | 6.7E-10 | 0.00067 | 6.695519 | | 8.152808 | 11.76048 | 21.51868 |
| 15 | 5.68E-10 | 0.000568 | 5.6802 | | 6.695519 | 8.950386 | 13.66722 |
| 10 | 4.68E-10 | 0.000468 | 4.679967 | | 5.348159 | 6.695519 | 9.02573 |
| 5 | 3.6E-10 | 0.00036 | 3.597124 | | 3.979255 | 4.679967 | 5.710453 |
| 1 | 2.34E-10 | 0.000234 | 2.339983 | | 2.495901 | 2.754591 | 3.081939 |
| 0.5 | 2.03E-10 | 0.000203 | 2.033857 | | 2.15063 | 2.339983 | 2.572055 |
| 0.1 | 1.56E-10 | 0.000156 | 1.559989 | | 1.62778 | 1.733982 | 1.858225 |
| 0.05 | 1.42E-10 | 0.000142 | 1.417729 | | 1.473499 | 1.559989 | 1.659831 |
| 0.01 | 1.17E-10 | 0.000117 | 1.169992 | | 1.207714 | 1.265208 | 1.330098 |

*Fig. 4*

| MATERIAL. | σ: MEGOHMS 50% HUMIDITY | σ: MEGOHMS 70% HUMIDITY | σ: MEGOHMS 90% HUMIDITY | ρ MEGOHMS-cms. |
|---|---|---|---|---|
| AMBER | $6 \times 10^{8}$ | $2 \times 10^{8}$ | $1 \times 10^{5}$ | $5 \times 10^{10}$ |
| BEESWAX, YELLOW | $6 \times 10^{8}$ | $6 \times 10^{8}$ | $5 \times 10^{8}$ | $2 \times 10^{9}$ |
| CELLULOID | $5 \times 10^{4}$ | $2 \times 10^{4}$ | $2 \times 10^{3}$ | $2 \times 10^{4}$ |
| FIBER, RED | $2 \times 10^{4}$ | $3 \times 10^{3}$ | $2 \times 10^{2}$ | $5 \times 10^{3}$ |
| GLASS, PLATE | $5 \times 10^{4}$ | $6 \times 10$ | $2 \times 10$ | $2 \times 10^{7}$ |
| GLASS, KAVALIER | $4 \times 10^{6}$ | $4 \times 10^{3}$ | $1 \times 10^{3}$ | $8 \times 10^{9}$ |
| HARD RUBBER, NEW | $3 \times 10^{9}$ | $1 \times 10^{8}$ | $2 \times 10^{3}$ | $1 \times 10^{12}$ |
| IVORY | $5 \times 10^{3}$ | $1 \times 10^{3}$ | $3 \times 10$ | $2 \times 10^{2}$ |
| KHOTINSKY CEMENT | $7 \times 10^{3}$ | $3 \times 10^{8}$ | $5 \times 10^{5}$ | $2 \times 10^{9}$ |
| MARBLE, ITALIAN | $3 \times 10^{3}$ | $2 \times 10^{2}$ | $2 \times 10$ | $1 \times 10^{5}$ |
| MICA, COLORLESS | $2 \times 10^{7}$ | $4 \times 10^{5}$ | $8 \times 10^{3}$ | $2 \times 10^{11}$ |
| PARAFIN (PAROWAX) | $9 \times 10^{9}$ | $7 \times 10^{9}$ | $6 \times 10^{9}$ | $1 \times 10^{10}$ |
| PORCELAIN, UNGLAZED | $6 \times 10^{5}$ | $7 \times 10^{3}$ | $5 \times 10$ | $3 \times 10^{8}$ |
| QUARTZ, FUSED | $3 \times 10^{5}$ | $2 \times 10^{3}$ | $2 \times 10^{2}$ | $5 \times 10^{12}$ |
| ROSIN | $6 \times 10^{3}$ | $3 \times 10^{8}$ | $2 \times 10^{3}$ | $5 \times 10^{10}$ |
| SEALING WAX | $2 \times 10^{9}$ | $6 \times 10^{3}$ | $9 \times 10^{7}$ | $8 \times 10^{9}$ |
| SHELLAC | $6 \times 10^{7}$ | $3 \times 10^{5}$ | $7 \times 10^{3}$ | $1 \times 10^{10}$ |
| SLATE | $9 \times 10$ | $3 \times 10$ | $1 \times 10$ | $1 \times 10^{2}$ |
| SULPHUR | $7 \times 10^{9}$ | $4 \times 10^{9}$ | $1 \times 10^{8}$ | $1 \times 10^{11}$ |
| WOOD, PARAFINED MAHOGANY | $4 \times 10^{6}$ | $5 \times 10^{5}$ | $7 \times 10^{3}$ | $4 \times 10^{7}$ |

*Fig. 6*

◆ ASH 1 - 10% LOI, 100 deg F
△ ASH 2 - 10% LOI, 70 deg F
× ASH 3 - 19% LOI, 70 deg F
○ ASH 4 - 6% LOI, 70 deg F
—— POLY. (ASH 1 - 10% LOI, 100 deg F)
- - - POLY. (ASH 2 - 10% LOI, 70 deg F)
—— POLY. (ASH 3 - 19% LOI, 70 deg F)
— - POLY. (ASH 4 - 6% LOI, 70 deg F)

- △ ASH A - 10% LOI, 70 deg F, YIELD
- ◇ ASH B - 10% LOI, 70 deg F, YIELD
- ○ ASH C - 10% LOI, 90 deg F, YIELD
- □ ASH D- 10% LOI, 95 deg F, YIELD
- ▲ ASH A - 10% LOI, 70 deg F, LOI
- ◆ ASH B - 10% LOI, 70 deg F, LOI
- ● ASH C - 10% LOI, 90 deg F, LOI
- ■ ASH D- 10% LOI, 95 deg F, LOI
- —— POLY. (ASH A - 10% LOI, 70 deg F, LOI)
- - - - POLY. (ASH B - 10% LOI, 70 deg F, LOI)
- —— POLY. (ASH C - 10% LOI, 90 deg F, LOI)
- – – POLY. (ASH D- 10% LOI, 95 deg F, LOI)
- ▬▬ POLY. (ASH A - 10% LOI, 70 deg F, YIELD)
- - - - POLY. (ASH B - 10% LOI, 70 deg F, YIELD)
- —— POLY. (ASH C - 10% LOI, 90 deg F, YIELD)
- – – POLY. (ASH D- 10% LOI, 95 deg F, YIELD)

METHOD AND APPARATUS FOR SEPARATION OF UNBURNED CARBON FROM FLYASH

BACKGROUND OF THE INVENTION

1. Field of the Invention

The present invention relates to improvements in the process of separating carbon from flyash using a triboelectric, counter current, belt type separator and more particularly to controlling the relative humidity of the flyash fed into the separator to within an optimum humidity range.

2. Description of the Related Art

Worldwide, tremendous quantities of coal are burned to generate electricity. Typically, coal is pulverized to a fine powder, pneumatically conveyed into a boiler and burned as a dispersed powder with the heat that is liberated from the burning of the powder being used to produce steam to power turbines and generate electricity. In the boiler, the carbonaceous constituents in the coal burn and release the heat. The non-combustible materials are heated to high temperatures and typically melt and pass through and out of the boiler as flyash. This flyash is typically collected prior to the flue gases going up a stack and being dispersed into the atmosphere. For example, a 1,000 megawatt power plant can burn approximately 500 tons of coal per hour. Ash levels in the range of 10% are typical of many coals burned throughout the world. It follows that flyash is produced at very high volumes throughout the industrialized world.

The economic design of any power plant is necessarily a compromise between capital costs and operating cost. The cost of equipment to grind the coal and achieve complete combustion is balanced by the value of the BTUs liberated when the coal is burned and the cost of the coal prior to being pulverized. In addition, a factor that has become important in recent years is the air pollution produced by burning coal in large utility power plants. NOx (nitrous oxide) emissions are one example of air pollution that power plants are trying to reduce. NOx is formed by oxygen and nitrogen reacting at high temperatures and is favored by high temperature. One way to reduce NOx emissions is to reduce temperatures in the boiler and to reduce excess oxygen. This is typically done through utilizing what are called Low NOx Burners. Many boiler manufacturers produce such Low NOx Burners and many utilities are in the process of installing such devices. However, an undesired side effect of reducing the temperature and excess oxygen in the burners is an increase in the unburned carbon that is in the flyash leaving the boiler.

The passage of the non-combustible minerals through the high temperature boiler and subsequent collection of the flyash, is typically followed by a quenching in boiler tube passes, which turns the relatively inert clay and shale minerals in the coal into glassy ceramic type materials. A property of these glassy inorganic particles is that they are reactive with lime to form cementacious materials. This pozzolanic property of flyash is widely exploited by the industry, i.e., flyash is incorporated into concrete where it replaces some of the cement and reacts with free lime liberated during the hydration of the cement and produces cementacious materials resulting in a stronger concrete with less free lime, rendering it sulfate resistant, stronger and cheaper. One advantage of using flyash as a pozzolan in concrete is that it turns a high volume waste into a high volume useable material. Another advantage of using flyash in concrete to displace cement is a reduction in cement production. Cement is typically produced from minerals which are sources of calcium, alumina and silica. When cement is produced, these minerals are combined in a cement kiln and heated to incipient fusion. However, for every ton of cement produced, approximately two tons of minerals are mined and approximately one ton of $CO_2$ is emitted into the atmosphere; some of the $CO_2$ is from the fuel and some is from the limestone used as the source of calcium. Thus another advantage of replacing cement with flyash is that it reduces $CO_2$ emissions on a one for one basis. In particular, for each ton of flyash used, one ton less of $CO_2$ need be emitted.

The use of flyash in concrete requires that the flyash have specific physical properties. One of these properties, defined in American Society for Testing and Materials (ASTM) C618 specifications, is a carbon content of less than 6%. However, even this specification is really an upper limit and most users want the carbon content to be as low as possible. Unfortunately, the increase in carbon in the flyash leaving the boiler due to Low NOx Burners often causes the flyash carbon level to exceed acceptable limits as defined by potential flyash users. Thus there is a tradeoff, reducing one problem, NOx in the atmosphere, exacerbates another, $CO_2$ greenhouse emissions. Accordingly, removal of carbon from flyash, (e.g.,flyash produced from low NOx burners ) which enables the flyash to be used in concrete, benefits the utility power plant in that it avoids a waste disposal problem, benefits the concrete producer in that it uses a lower cost material than cement, and also benefits the environment in that $CO_2$ emissions are reduced.

A number of methods have been proposed for carbon removal from flyash including low temperature combustion, froth flotation, particle size classification and electrostatic separation. Electrostatic separation encompasses a number of different technologies based upon the electrical properties of the particles being separated. One type of electrostatic separation is conductor/non-conductor separation which depends upon conductivity differences between dissimilar particles. Typically, particles are charged either by corona or through contact with a conductive surface and a rate of charge flow into or out of the particle in contact with a conductive surface determines which particles are accepted and which particles are rejected. Separators of this type are well described in the literature—see for example, Chapter 6 of the Society of Mining Engineers (SME) Mineral Processing Handbook, edited by Norman L. Weiss, copyright 1985 by American Institute of Mining, Metallurgical and Petroleum Engineers (Library of Congress catalog card number 85-072130). However, a problem common to all of these conductive/non-conductive type separators is a need for each particle to contact a conductive surface. For fine particles, the requirement to contact a conductive surface presents a number of difficulties, such as, for example, adhesion of particles to the conductive surfaces and reduction in separator capacity due to the dependence of the separator capacity on the surface area times the particle thickness.

Another type of electrostatic separation method utilizes contact charging and will hereinafter be termed triboelectric electrostatic separation. In this method, which is also described in the SME Mineral Processing Handbook, particles are charged by virtue of contact with each other. This has the advantage of not requiring contact with a conductive surface and in principal allows particles of smaller size to be separated. The SME Mineral Processing Handbook places a lower limit of 20 microns on this type of separator based on the author's practical experience. However, a triboelectric counter-current belt type separator as described by Whitlock, U.S. Pat. Nos. 4,839,032 and 4,874,507, has been successfully and consistently operated with particles much finer than 20 microns, and has been used to separate carbon from flyash (See, for example, Whitlock, (1993) "Electrostatic Separation of Unburned Carbon from Flyash "Proceedings Tenth International Ash Use Symposium, Volume 2, pp. 70-1–70-12).

The scientific and engineering literature contains extensive discussion of the importance of low ambient humidity for the observation and practice of electrostatic effects. The reason given is that films of water on solid surfaces are conductive and this surface conduction bleeds away any charge on the particles and so renders the separation ineffective. Furthermore, the literature explains that fine particles absorb moisture and can agglomerate due to that absorbed moisture. Accordingly, the combined effects of the conductive films of water and agglomerating of particles due to moisture necessitate operation of electrostatic separators in low humidity regions. For example U.S. Pat. No. 5,513,755 by Heavilon et al. discusses the importance of low humidity to avoid aggregation of the particles. In particular, Heavilon et al. discloses an electrostatic separator that charges carbon particles either by contact with a conductive belt or by induction, the charged carbon particles being released from a layer of flyash traveling on the conductive belt by means of agitation of the layer of flyash by beater bars disposed below the conductive belt. The charged carbon particles fly up into contact with an electrode and assume, by contact, an opposite charge. The oppositely-charged particle eventually moves downwardly and outwardly from the electrode into a product reject hopper or bin. Thus the electrostatic separator of Heavilon et al. is the conductor/non-conductor type described above, which depends upon the conductivity of the carbon particles to become charged and the nonconductive ash minerals to remain uncharged, and suffers from the disadvantages discussed above.

The heating of transport air used to transport flyash from a remote collection bin to, for example, an electrostatic separator and hence the heating of air used in the bulk pneumatic transport of flyash to drive off moisture is commonly practiced by the electric utility industries. Alternatively, Heavilon et al. describes the use of a heater prior to delivering the flyash to a hopper that delivers the flyash in a thin layer over the conductive belt of the electrostatic separator, the heater heats the flyash to a sufficiently high temperature, above the dew point, to drive off moisture sufficient to break the surface bond between the carbon and ash. This is a reference to a pendular state of water in an aggregation of particles described, for example, in Perry's Chemical Engineering Handbook, $6^{th}$ edition Mcgraw Hill, 1984. In other words, "small amounts of liquid are held as discrete lens-shaped rings at the points of contact of the particles." The size of these lens-shaped bridges of water depends upon the surface tension (T) of water, and the amount of water present. Referring to the Kelvin equation (1) below, the surface tension (T) is a function of the pressure difference (P) or capillary suction and the radius of curvature (R) across a curved surface of the meniscus:

$$P=2T/R \quad (1)$$

As discussed by W. B. Pietsch in chapter 7.2 entitled "Agglomerate Bonding and Strength," of the Handbook of Powder Science and Technology, edited by M. E. Fayed and L. Otten, 1984, Van Nostrand, Library of Congress number 83–6828, when the surface roughness of the particles exceeds the size of the pendular bond, then the liquid bridge breaks off the larger particle and the force holding the particles together decreases. Presumably, this is the moisture level necessary to "break the bond" between the carbon and the flyash.

However, Heavilon et al. are silent with respect to any measurement of moisture levels or to a specific range of moisture content level which is desirable for operation of their conductivity-based separator. In addition, the literature only discusses removal of moisture to facilitate free flow of particles and removal of moisture to avoid conductive films of moisture on non-conductive particles. It follows from the literature that low humidity would avoid both of these problems and by implication, the lower the humidity the better.

SUMMARY OF THE INVENTION

Surprisingly, as will be described in detail herein, it has been found that for the case of flyash and unburned carbon, there is an optimum humidity range of flyash which causes an improvement in separation using triboelectric separators.

According to one embodiment of this invention, the relative humidity of the flyash being fed to the triboelectric separator is controlled such that a predetermined humidity range is maintained.

According to a method embodiment, the method of separating carbon particles from flyash includes the steps of modifying the relative humidity of the flyash to within an optimum humidity range and introducing the treated flyash into a triboelectric separator so as to triboelectrically charge the carbon particles and the flyash, and electrostatically separate the charged carbon particles from the charged flyash. In particular, the relative humidity may be increased by adding water to the air used to transport the flyash from a remote collection bin to the triboelectric separator. Alternatively, the relative humidity of the flyash is increased by adding water to the flyash just prior to the flyash entering the triboelectric separator. In addition, for each of these embodiments, the water can either be in a liquid state or in a vapor state.

In an alternative embodiment, the relative humidity of the flyash is decreased to within the optimum humidity range. In particular, the relative humidity of the flyash is decreased by heating the air transport system, for transporting the flyash from the remote collection bin to the separator, to above an ambient temperature, maintaining the air transport system above the ambient temperature, disengaging air from the flyash while the air transport system is still above the ambient temperature, and collecting flyash at above the ambient temperature. In a still further alternative embodiment, air is heated prior to being used to fluidize the flyash.

An apparatus for separating carbon particles from flyash, according to the present invention, includes a flyash treating means for modifying (increasing or decreasing) the relative humidity of the flyash to be within the optimum humidity range. A triboelectric separator is coupled to the flyash treating means; it receives the treated flyash and triboelectrically charges the carbon particles and the flyash so as to electrostatically separate the charged carbon particles from the charged flyash.

In one embodiment of the apparatus, the flyash treating means includes a means for adding water to the transport air used to transport the flyash from the remote collection bin to the separator. Alternatively, the flyash treating means includes a means for adding water to the flyash either just prior to the flyash entering the separator or within a flyash collection silo feeding the separator.

An alternative embodiment of the flyash treating means is a heater for heating the transport air used to transport the flyash from a remote collection bin to the separator, prior to the transport air being combined with the flyash. Alternatively, the flyash treating means is a heater for heating air that is used to fluidize the flyash, for example, once collected in the flyash collection silo just prior to entering the counter current belt type separator. For either of these embodiments, the air transport system and the flyash collection silo can also be insulated to reduce any heat loss of the air transport and storage system.

In another embodiment of the present invention, a utility power plant includes a coal-fired boiler that burns coal to produce heat that is used to generate electricity, wherein the coal-fired boiler also produces non-combustible materials that exit the boiler in the form of flyash exiting with flue gases. The utility power plant also includes an ash disengagement system coupled to the coal-fired boiler that collects the flyash from the flue gases and a flyash transport system that transports the collected flyash from the ash disengagement system to a remote storage vessel. In addition, the utility includes a means for one of increasing a relative humidity of the flyash and decreasing the relative humidity of the flyash to be within an optimum humidity range and a triboelectric separator that receives the treated flyash and that triboelectrically charges the carbon particles within the treated flyash as well as the treated flyash so as to electrostatically separate the charged carbon particles from the charged flyash.

Other objects and features of the present invention will become apparent from the following detailed description when taken in connection with the following drawings. It is to be understood that the drawings are for the purpose of illustration only and are not intended as a definition of the limits of the invention.

BRIEF DESCRIPTION OF THE DRAWINGS

The foregoing and other objects and advantages will be more fully appreciated from the following drawing in which:

FIG. 4 is a table of the relative humidity and corresponding radii of curvature for several water and salt solutions;

FIG. 6 is a table of volume and surface resistivity for various materials at different relative humidities;

DETAILED DESCRIPTION

Figure 1:
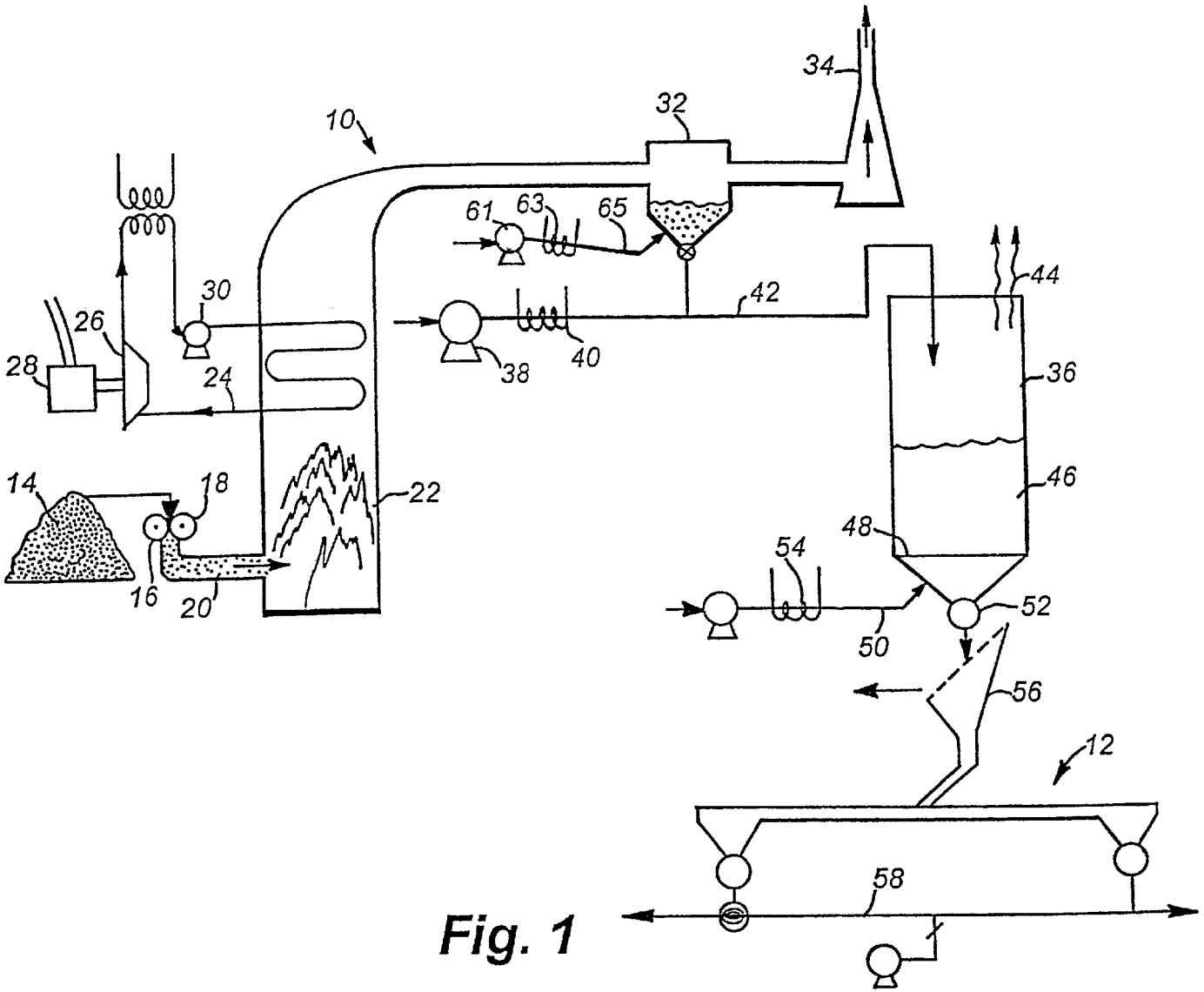
FIG. 1 is a schematic diagram of a coal fired electric generating plant illustrating an ash transport, storage and processing system with a triboelectric electrostatic counter-current belt separator.

FIG. 1 is a schematic diagram of an electric generating plant 10 including a coal fired boiler 22, and a mechanism for flyash transport, storage and processing with a triboelectric electrostatic counter current belt separator 12, such as is described in U.S. Pat. Nos. 4,839,032 and 4,874,507 (hereinafter the '032 and '507 patents), herein incorporated by reference. As is typical in industry practice, the coal 14 is pulverized, for example, by rollers 16, 18, and pneumatically conveyed by conveyor 20 to the boiler 22 where it burns as a dispersed powder. The burned coal heats a tube 24 containing water thereby heating the water to form steam which expands through a turbine 26 driving a generator 28 to generate electricity. The steam is also condensed back into liquid water and is pumped by pump 30, back into the boiler where it is continuously heated and condensed within, the closed loop system. Any unburned material of the burned coal passes by the heat transfer tubes in the form of flue gases to an ash disengagement system such as, for example, an electrostatic precipitator hopper 32, where the ash solids are removed and where the flue gas passes through and up a stack 34 where it is dispersed into the atmosphere.

In the system of FIG. 1, the ash solids are conveyed from the precipitator hopper 32 to a remote storage vessel silo 36. Typically, air is compressed by a compressor 38 and heated by a heater 40 prior to entraining the ash for conveying by conveyor 42 to the silo 36. At the silo, the conveying air disengages at an exit port 44 and the ash 46 accumulates in the silo. At a bottom 48 of the silo, fluidizing stones (not illustrated) are used to admit air via an air transport 50 so as to fluidize the flyash so that it will flow easily through an exiting port 52. Typically, this fluidizing air is also heated by a heater 54. The silo is connected to the triboelectric, counter current, belt type separator 12. As the flyash leaves the silo, it is passed through a screen 56, for example within a hopper, to remove any tramp material which might otherwise interfere with separator performance. After passing through the screen, the flyash is then introduced into the separator where the carbon is triboelectrically charged and is electrostatically separated from the flyash. A means for conveying and distributing 58 the flyash in a uniform manner is also used. A detailed description of the fluidizing feeder, the separator and the means for conveying and distributing the flyash is described in the '032 patent.

As discussed above, conventional practice in the transport and storage of flyash is to keep the flyash as dry as possible, to prevent aggregation of the particles and to break the surface bond between the carbon and the flyash. This can be done, for example, by heating the transport air. In the embodiment of FIG. 1, the air used to convey the ash from the precipitator 32 to the silo 36 is heated by the heater 40. Similarly, the air used to fluidize the ash in the precipitator hopper is heated by heater 63, and the air used to fluidize the accumulated ash in the silo is heated by heater 54. Heating of the air causes the ash air system to be hotter than when using ambient air. The motion of the flyash in the transport air rapidly results in equilibrium between the air in contact with the flyash and the flyash. The equilibrium both in temperature and in relative humidity is quite rapid. Typical industry practice is to design such transport systems for the worst case conditions, and to operate them the same way year round. However, one disadvantage, for example, of a transport system designed to keep ash dry and free flowing in humid summer conditions is that it is over designed for use in the dry winter months.

Figure 2:
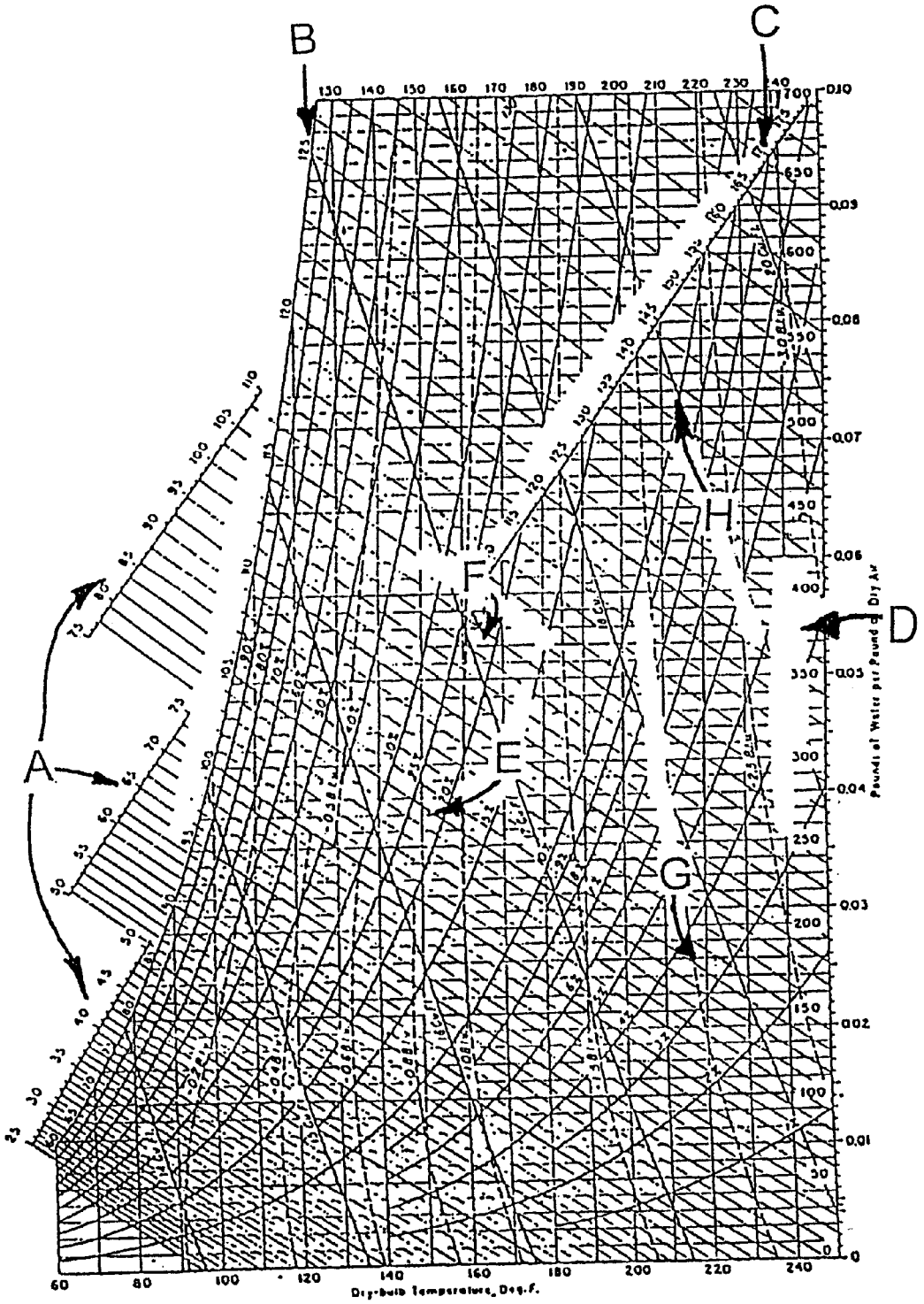
FIG. 2 is a psychrometric chart showing properties of air and water vapor at various temperatures and a barometric pressure of 29.92 in Hg.
Figure 2A:
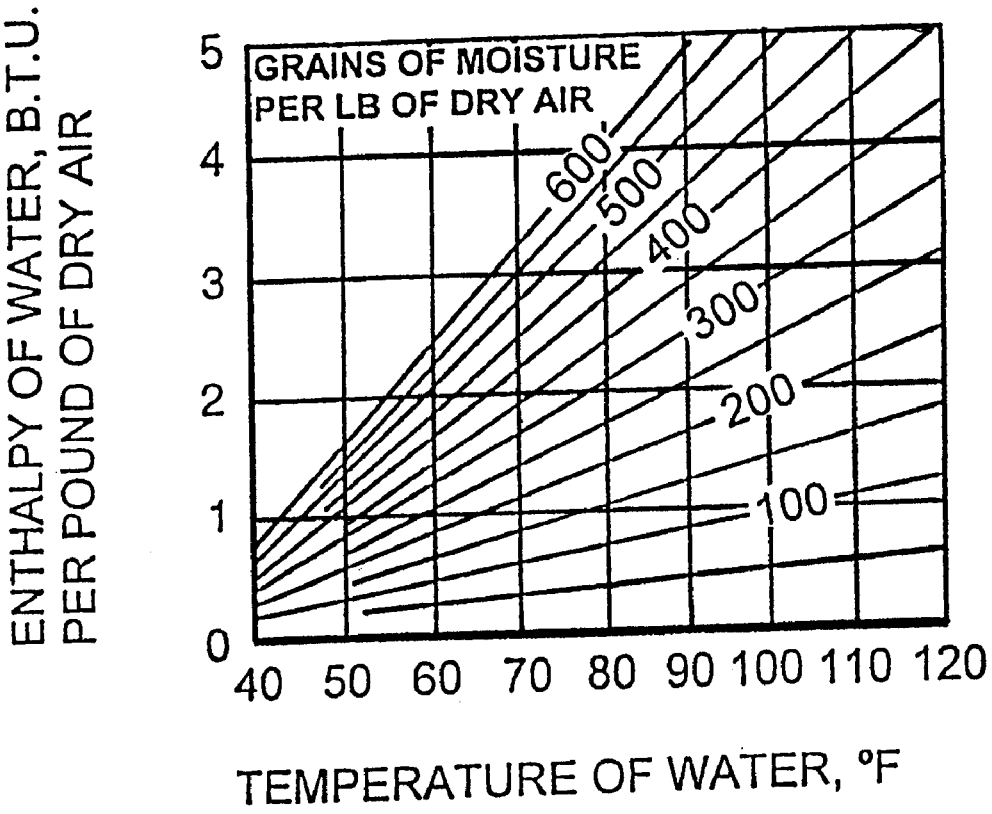
FIG. 2A is a chart showing the Enthalpy of Water per pound of Dry Air versus temperature of the water.

The driving force for movement of water between phases is the chemical potential. At equilibrium, all phases have the same chemical potential. Arbitrarily, a pure condensed phase is taken as having a chemical potential of unity. Thus liquid water and water vapor at equilibrium have the same chemical potential and there is no net driving force to move water from one phase to the other. In a flyash system, with water, a convenient measure of water activity is relative humidity. At saturation or 100% relative humidity, the air is in equilibrium with liquid water. At 0% relative humidity, the air has 0% water content. Relative humidities between 0% and 100% reflect the chemical potential of water at those different water concentrations in the atmosphere. The vapor pressure of water increases exponentially with temperature so increasing the temperature of the air increases the saturation temperature, increases the saturation partial pressure and so at constant water content the relative humidity will drop. Psychometric charts such as published in Perry's Chemical Engineers Handbook, Sixth Edition, Mcgraw Hill, 1984 and reproduced here as FIGS. 2 and 2A, graphically illustrate the equilibrium content of air with water at different temperatures and relative humidities, and the Enthalpy of Water at different temperatures of the water. In FIG. 2 the curves represented by the letter A are the lines of Enthalpy of Saturation—B.t.u. Per Pound of Dry Air; the curves represented by B are the Wet Bulb and Dew Point or Saturation Temperatures; the curves represented by C are the Enthalpy at Saturation—B.t.u. Per Pound of Dry Air; the curves represented by D are the Grains of Moisture Per Pound of Dry Air; the curves represented by E are the curves of Relative humidity; the curves represented by F are the Wet Bulb Temperatures; the curves represented by G are the Enthalpy deviation—B.t.u. Per Pound of Dry Air; and the curves represented by H are the Cubic Feet Per Pound of Dry Air. It follows from the above that heating a solid material per se does not change the materials relative humidity. Heating a material in contact with air increases the saturation partial pressure of water and at a constant absolute humidity reduces the relative humidity. Heating a material in a closed container to 100° C. has no effect on the relative humidity.

Figure 3:
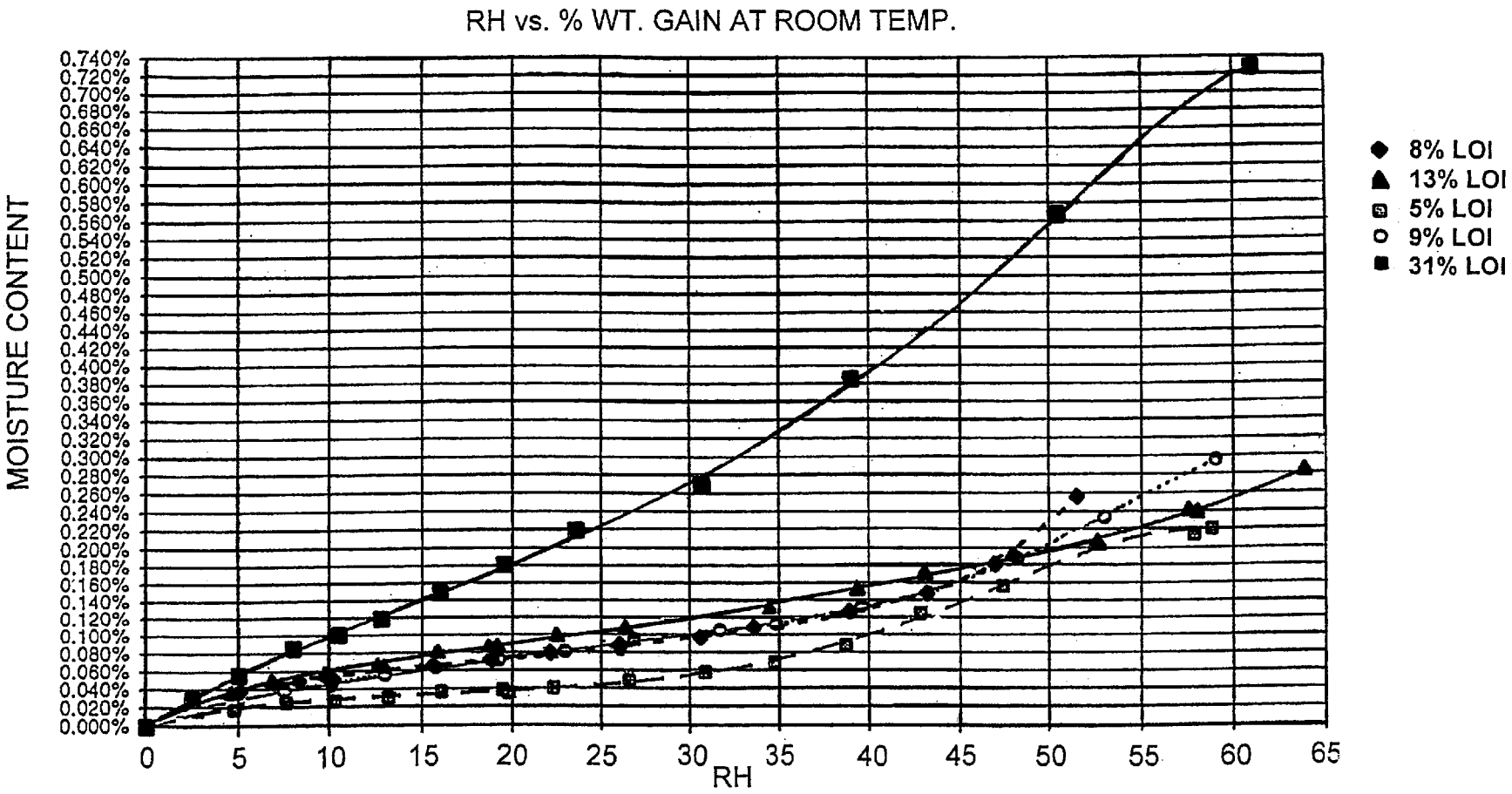
FIG. 3 is a graph of a moisture content of several flyashes verses relative humidity.

FIG. 3 is a graph of the moisture content of a flyash vs. the relative humidity of air and for different amounts of unburned carbon, expressed as Loss On Ignition (LOI%). The experimental data was obtained with a water absorption system consisting of an analytical balance with an under balanced suspended sample pan; a sample chamber with a temperature control and a purge gas control; a system for adjustment of purged gas relative humidity to provide a final chamber relative humidity between 0% and 65% relative humidity at a constant flow rate; and a Vaisala relative humidity probe for continuous monitoring of the chamber relative humidity. The procedure for collecting the data included assembling the water absorption system and balance while purging the chamber at the experimental purge gas flow rate to adjust buoyancy effects; placing 10 to 15 grams of flyash to be analyzed on the balance pan and assembling the heating chamber; with 0% relative humidity air flow, adjusting the chamber temperature to 222–250° C. and holding the temperature constant for approximately 30 minutes to remove absorbed water from atmospheric exposure; cooling the sample and the chamber to a desired experimental temperature while maintaining a 0% relative humidity purge gas; recording the dry sample weight at 0% relative humidity; obtaining a sample weight of the sample with increases in relative humidity at increments of approximately 2% relative humidity after an equilibration time of a minimum of 10 minutes for each data point, the data set including the sample weight at the relative humidity; calculating the percent weight increase from the sample dry weight for each relative humidity increment; and providing the absorption isotherm chart of FIG. 3 by plotting the percent weight gain versus the relative humidity for each relative humidity increment.

It can be seen from FIG. 3 that the moisture content increase with relative humidity is greater in flyash with higher amounts of unburned carbon. The dependence of moisture content vs. relative humidity of flyash on carbon content can be explained by the carbon preferentially absorbing more water than the inorganic ash particles. As was discussed above, the residual carbon in flyash is derived from the coal which did not completely burn. The coal has been heated to a high temperature, its volatile constituents vaporized and a partial oxidation has occurred. This results in carbon particles that are porous and have a low bulk density. It is this porosity that contributes to the high water absorption of the carbon relative to the non porous glassy minerals. Water that is trapped inside a carbon particle in pores is not available on the surface to interact with any particle surface properties that would affect separation.

It is known that across a curved surface, a surface tension (T) of fluid exerts a force which results in a pressure difference (P) across the curved surface. This pressure difference (P) is equal to twice the surface tension (T) divided by a radius of curvature (R) of the surface and is known as Kelvin's Capillary Equation:

$$P=2T/R \tag{1}$$

When bulk liquid water is in equilibrium with its vapor, the pressure difference across the water vapor interface is zero, the radius of curvature goes to infinity and there is a flat interface between the liquid and vapor. At equilibrium with a water partial pressure less than saturation, the system can only be at equilibrium with a curved surface such that the pressure difference across the curved interface equals the relative humidity. The change in surface tension with radius of curvature and salt content can be neglected.

Figure 5:
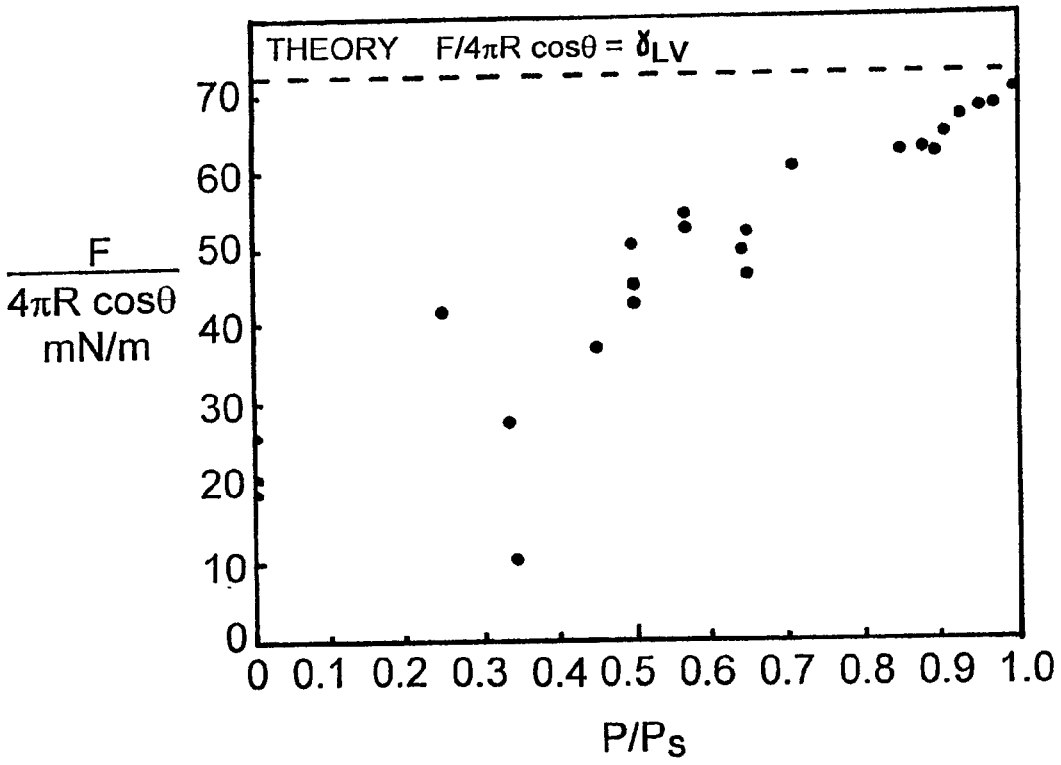
FIG. 5 illustrates a measured force of adhesion between two surfaces as a function of relative humidity.

A table of relative humidity vs. characteristic interface radius is shown in FIG. 4 for pure water and for several saturated salt solutions. The salts modify the relationship to some extent by lowering the relative humidity of bulk liquid water phase. This would result in increased radii of curvature at any given relative humidity, but the increase at very low relative humidities is not very great. As can be seen from the table of FIG. 4, low relative humidities have low characteristic interfacial radius of curvature. The assumption of water and solid materials behaving as continua breaks down when dimensions of the order of molecular dimensions are approached. This occurs for water in the tens of percent relative humidity. At this point the absorption of water is no longer a purely physical contact capillary action phenomenon but rather it becomes a chemical absorption or chemisorption. In an invited review paper by P. F. Luckham in Powder Technology, 58 (1989) 75–91, entitled "The Measurement of Interparticle Forces" there is disclosed work demonstrating that the applicability of bulk thermodynamics to menisci is established for water down to a radius greater than 40 angstroms which is approximately 20 water molecules. P. F. Luckham illustrates, as reproduced here as FIG. 5, a plot of a measured force of adhesion, scaled by the $4\pi R_{cos}\theta$, as a function of relative vapor pressure P/Ps (humidity) of water. As can be seen from FIG. 5, the force of adhesion decreases monotonically with relative humidity. The adhesion at 0% relative humidity is simply the dry adhesion between the two mica surfaces used in these experiments.

Water solutions of electrolytes are electrically conductive due to mobile charge carriers, in particular, the positive and negative ions in the solution. These ions form because of the polar nature of water and they exist as hydrated ions. When a water layer is thin compared to the thickness of a hydrated ion, the conductivity of that system becomes low. In particular, the conductivity of the surface film decreases exponentially with decreasing thickness. Thus the electrical conductivity of surface films of water becomes low when the surface films become too thin to allow appreciable movement of dissolved ions. The reduction in conductivity is monotonic with water content. When the film becomes thin the conductivity of the particle is dominated by the bulk volume conduction.

Reproduced in FIG. 6, from the Smithsonian Physical Tables, Volume 88, Eight revised Edition, published by the Smithsonian Institution, 1934 is a table of volume and surface resistivities of solid dielectrics. The volume resistivity, ρ, is the resistance between two opposite faces of a centimeter cube. The surface resistivity, σ, is the resistance between the opposite edges of a center square of the surface. The surface resistivity usually varies through a wide range with the humidity. All materials show an increase in resistivity with decreasing relative humidity.

Work by the U.S. Bureau of Mines and published by Foster Fraas in U.S. Bureau of Mines Bulletin #603, 1962, "The Electrostatic Separation of Granular Minerals" (hereinafter "the work") has determined some of the effects of humidity on separation. For example, the work in Chapter 7 discusses the effect of humidity on surface conductivity of particles, as well as effects of humidity on contact charging type separators. In discussing the effects of humidity on the triboelectric separation of quartz and feldspar the work states "With relative humidities as high as 20 percent satisfactory separation was obtained." At low humidity both quartz and feldspar charge negatively with respect to aluminum. At a higher humidity the feldspar begins to charge positive and at still higher the quartz begins to charge positively. At very high humidity the charging of both materials ceases. The work explains this through two effects; one the surface conductivity and two the particle surfaces becoming similar as a result of the same moisture film being absorbed on all the surfaces. In the case of quartz and feldspar this absorbed humidity results in a change in sign of particle charging with respect to aluminum. With an increasing coating of moisture the 3 surfaces quartz, feldspar and aluminum all become more similar.

Figure 7:
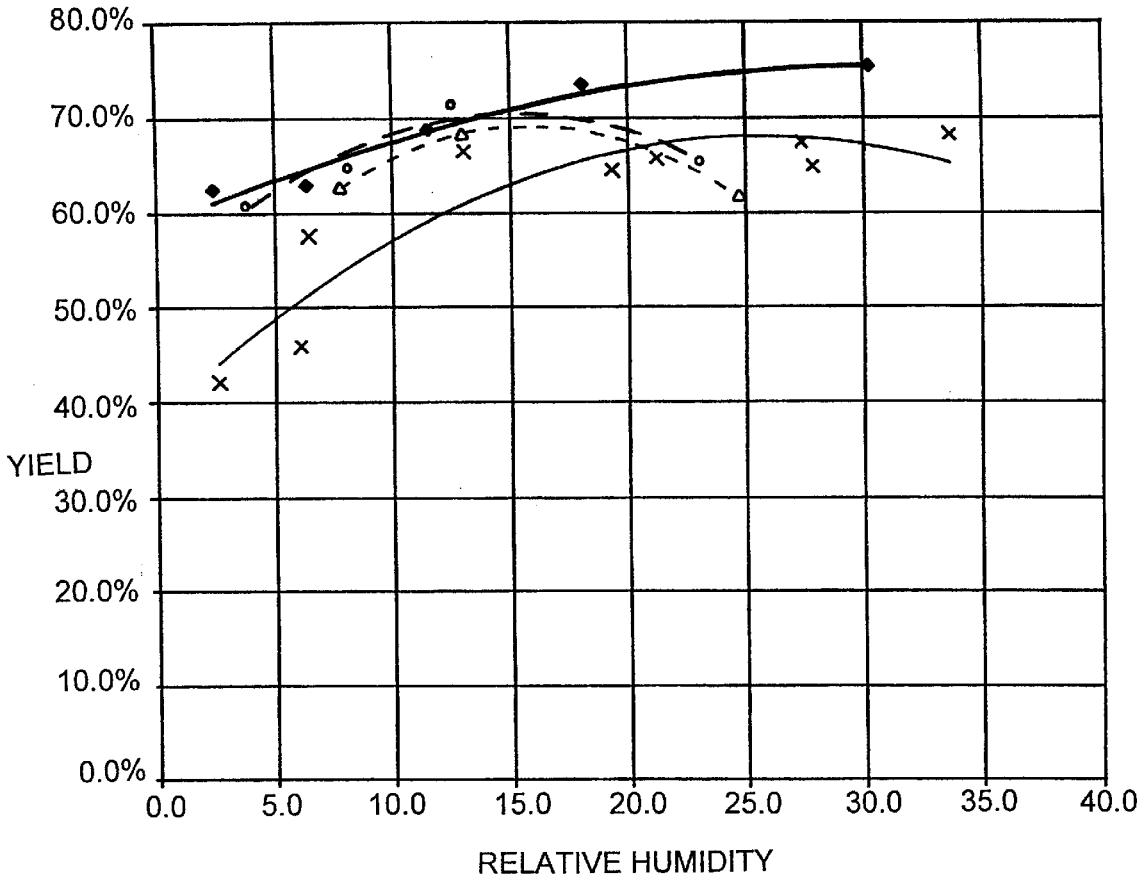
FIG. 7 is a graph of a yield of a low carbon ash product as a function of relative humidity.

The changes in yield that have been measured when triboelectrically separating flyash with changes in relative humidity are more subtle. In all cases the carbon continues to charge positively and the glassy inorganic minerals charge negatively. There is however, an improvement in yield of low carbon material within an optimum humidity range. FIG. 7 illustrates plots of the yield of low carbon product and the carbon content of that product verses relative humidity of the feed ash prior to processing. These relative humidity measurements are quite precise. The ash samples were prepared by mechanically mixing the flyash in a concrete mixer while in contact with cloth bags of zeolite molecular sieves. The ashes were dried to at or below the relative humidity under test. If necessary, water was then added to bring the relative humidity up to the desired level for the test. The samples were protected from contact with the atmosphere and when fluidizing or purge gas was used the gas was supplied at the relative humidity under test, except for the very lowest relative humidities where dry air was used. The test separator used had been specially modified to maintain the humidity of the samples undergoing processing. The two products after the separation were also tested to ensure that the relative humidity had not changed significantly. The humidity was measured with a relative humidity probe manufactured by Vaisala, Inc., 100 Commerce Way, Woburn, Mass. 01801, (617) 933–4500 (HMP 35 or 36 with HMI 31 display). These probes are regularly calibrated through comparison with saturated solutions of various salts at specified temperatures. At low relative humidities, the probes would sometimes require ten minutes to reach a stable level.

The graphs of FIG. 7 clearly show a maximum yield at some relative humidity. In addition, FIG. 7 shows that the low carbon products have an optimum humidity range. Optimization of any process requires trading off the various relevant parameters and maximizing the economic value of the process. In the case of carbon removal from flyash, the carbon must be removed to a level that is acceptable to the user, and then the yield must be maximized. For example if the local ash users require a carbon content of 3%, then yield should be maximized while producing ash with 3% or less carbon. Table 1 shows data taken from FIGS. 7, 8 and 9. In the first column is the relative humidity at which the ash product just meets the 3% LOI specification. The next column shows the yield at the relative humidity where the composition meets the 3% LOI specification.

TABLE 1

| ASH | RH @ WHICH PRODUCT IS 3% LOI | YIELD AT THE RH WHERE COMPOSITION IS 3% LOI | RH AT MAX YIELD | MAX YIELD | RH OF MAX YIELD USABLE PRODUCT | YIELD AT |
|---|---|---|---|---|---|---|
| 1 | 30% | 75% | 30% | 75% | 30% | 75% |
| 2 | 20% | 67 | 15 | 70 | 15 | 70 |
| 3 | 22 | 60> | 25 | 68 | 22 | 67 |
| 4 | >25 | 60 | 15 | 70 | 15 | 70 |
| A | >25 | 35 | 14 | 65 | 14 | 65 |
| B | 15 | 72 | 12 | 73 | 12 | 72 |
| C | >25 | 45 | 9 | 60 | 9 | 60 |
| D | 29 | 75 | 25 | 78 | 25 | 78 |

The explanation for this behavior is unclear. Conductivity of the particles is probably not an issue. The carbon in flyash is very conductive, with a resistivity of about 0.004 ohm cm, so conductive that a film of moisture would not have a measurable effect on the carbon conductivity. The ash is more than 10 orders of magnitude less conductive. Nevertheless, the particle conductivity is not an important factor in the operation of a triboelectric, counter current, belt type separator, and the proportional change in surface conductivity in the 5 to 25% relative humidity range is not great. Agglomeration is not likely to be the sole explanation either. Lower relative humidity would lead to less agglomeration which should result in continued improvement in separation results. Instead an optimum relative humidity and an optimum relative humidity range for separation is observed. As the particles are dried and the moisture films become thinner, the surfaces become increasingly dissimilar as they become drier. Particle charging is not expected to change sign as particles become less similar, and good separation would not be expected to deteriorate.

Figure 8:
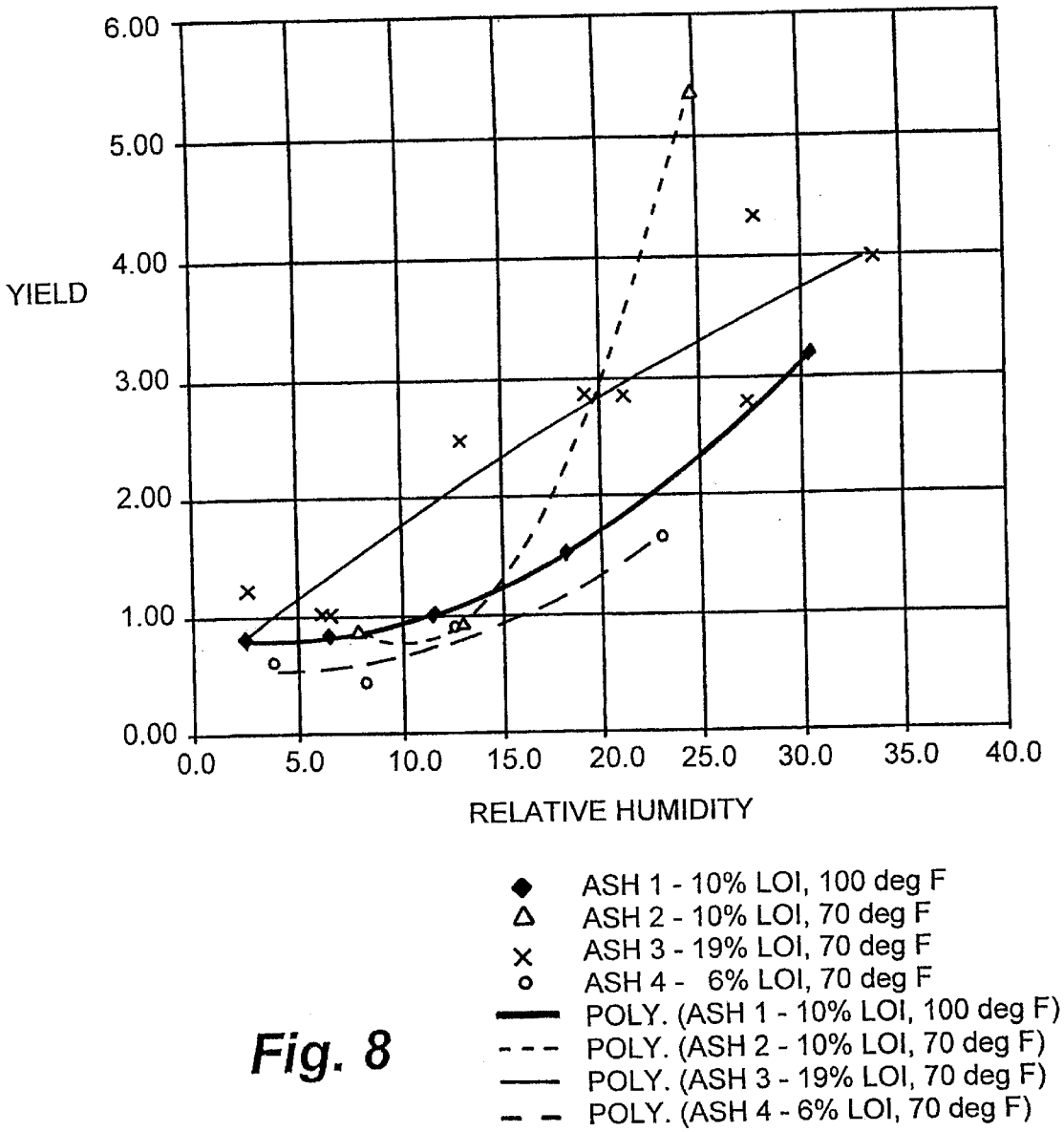
FIG. 8 is a graph of low carbon ash carbon content as a function of relative humidity.
Figure 9:
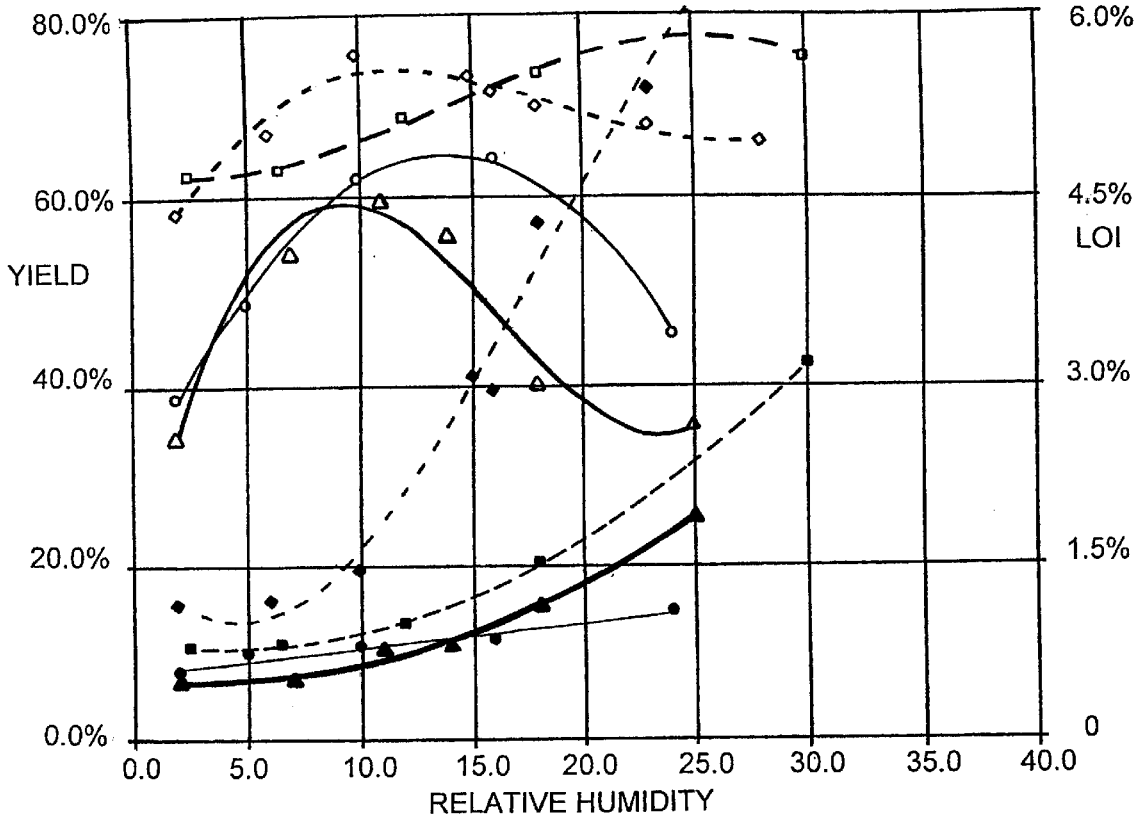
FIG. 9 is a graph of a yield and carbon content of a carbon ash product for two different temperatures.

FIGS. 7 through 9 are graphs of product yield and product purity for a number of different flyash samples as a function of relative humidity. In addition, FIG. 9 illustrates the product yield of a low carbon flyash sample as a function of two different temperatures. As illustrated in FIGS. 7–9, all the samples show a peak in product yield with relative humidity, and an optimum humidity range, with degradation in yield at very low and at very high relative humidity, and a degradation in product purity at very high relative humidity. The precise position of this optimum relative humidity and the optimum humidity range is somewhat dependent on the temperature of operation and is somewhat different for different samples of flyash. Referring to FIG. 9, it can be seen that the optimum relative humidity increases somewhat with temperature for this ash, and that the absolute yield is higher also.

Removal of water from materials is well known and many techniques and commercial pieces of equipment are available. Heating a material while in contact with air reduces the air relative humidity so that moisture can move from the material to the air. For example, This can be accomplished with flyash by heating the air prior to contacting the ash, or heating the ash prior to contacting the air, or heating them both while they are in contact. Fine particle drying equipment utilize all three methods. Virtually all flyash installations already utilize heated air for transport, so increasing this heating, if necessary, is a simple task. Dehumidifying the air prior to ash transport is also practiced sometimes, but this is in general more expensive.

Figure 10:
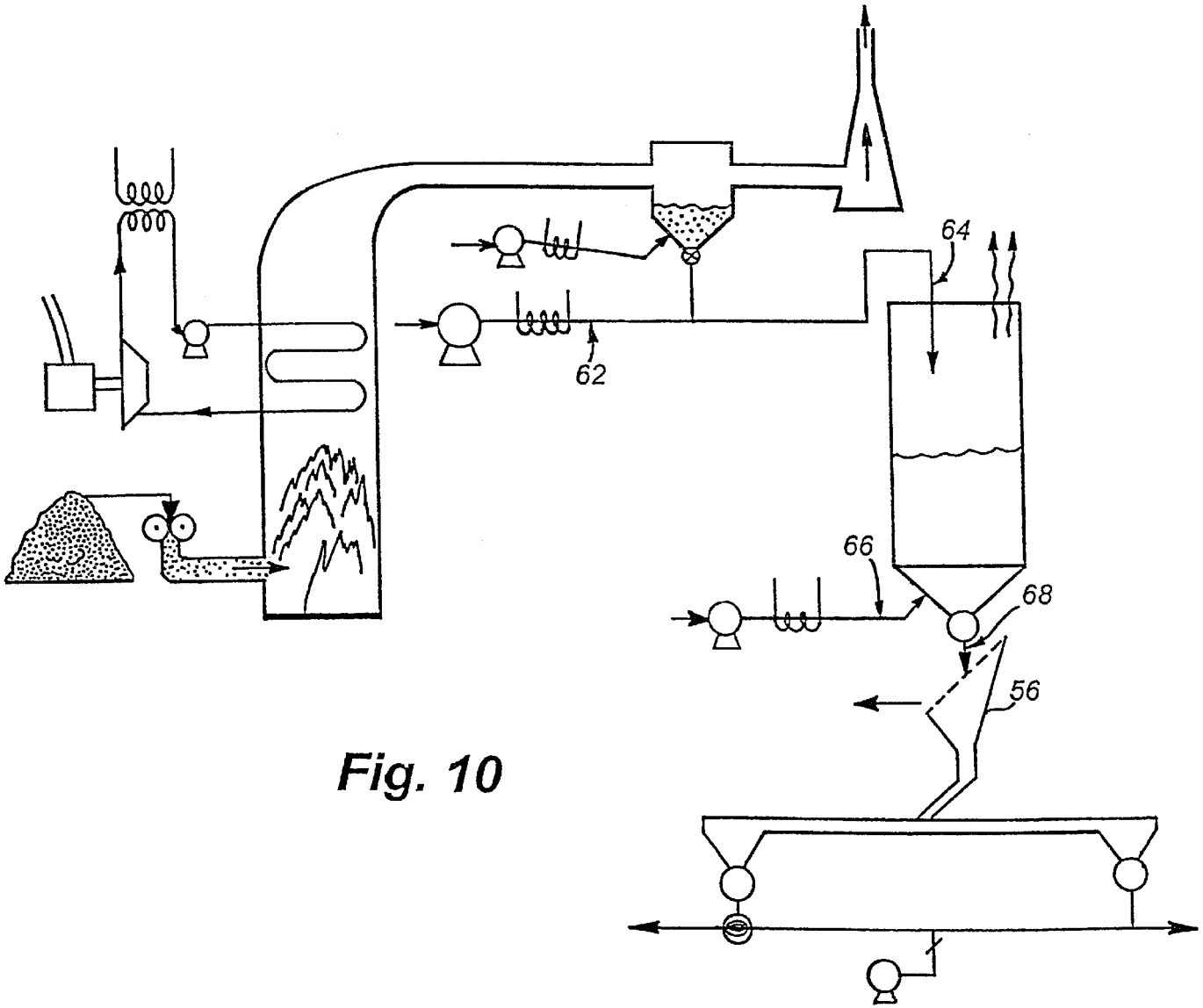
FIG. 10 is a schematic diagram of a coal fired electric generating plant illustrating several embodiments for increasing the relative humidity of the ash, according to the present invention.
Figure 11:
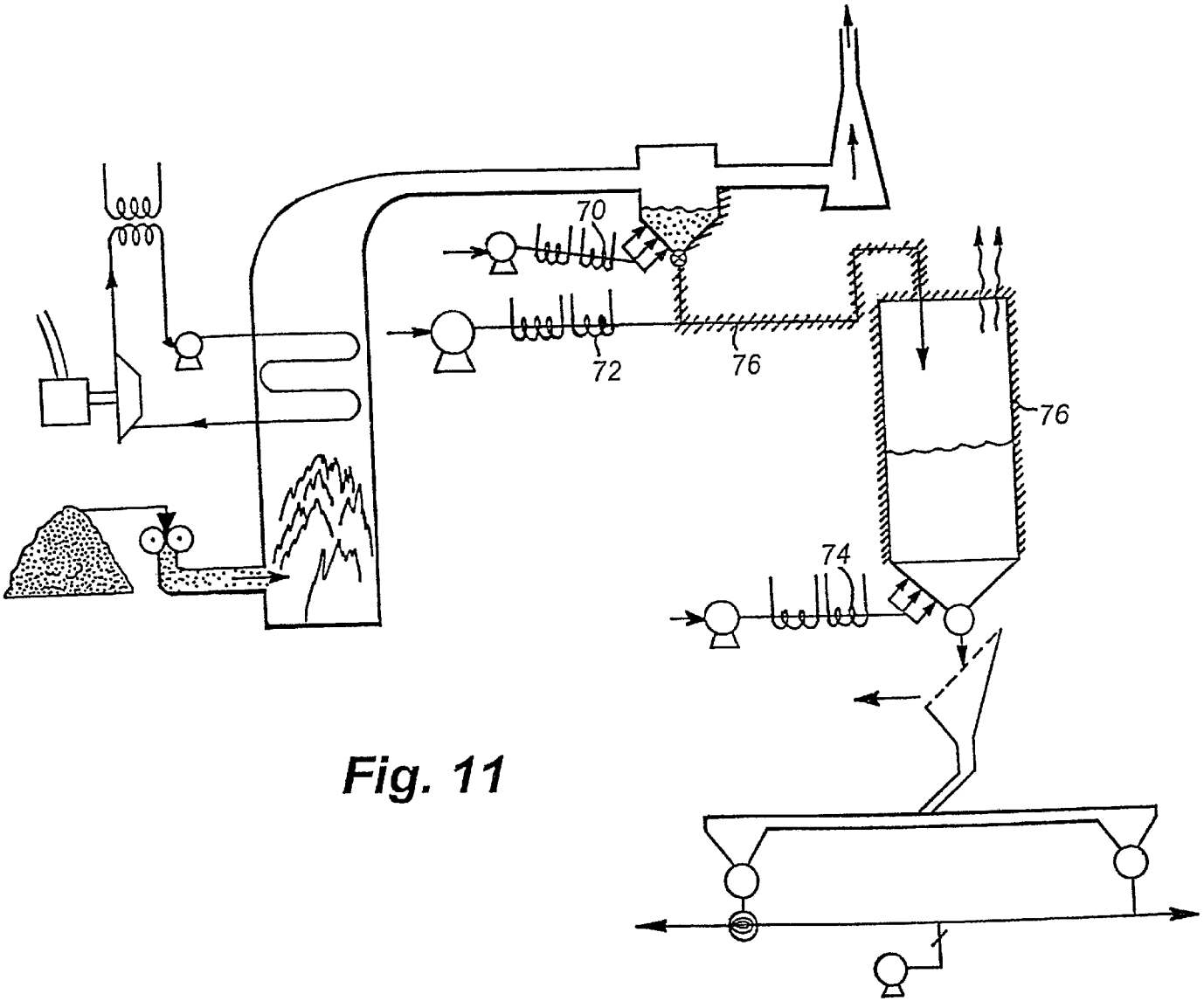
FIG. 11 is a schematic diagram of a coal fired electric generating plant illustrating several embodiments for decreasing the relative humidity of the ash according to the present invention.

An object of this invention is to control the relative humidity of the flyash being fed to a separator such that a specific optimum humidity range is maintained. Usually control will require means both to increase the relative humidity and means to decrease the relative humidity. FIG. 10 shows a method for increasing the relative humidity by injecting water at various points 62, 64, 66, 68 in the ash transport system between the precipitator hopper 32 and the separator 12. FIG. 11 shows a number of methods for decreasing the relative humidity of the ash including additional heating of the transport air by heater 72, reduction of the heat loss during transport by insulating the transport system 42 and silo 36 with insulation 76, increasing a flow rate of the transport air via the transport system (38, 40, 42), and a particularly effective technique is increasing the precipitator fluidizing air systems (61, 63, 65) at the precipitator hopper or at the bottom of the silo (54, 50). Not illustrated are either drying the air prior to compression or dehumidifying the air after compression. However, methods for drying and humidifying materials are well understood and one skilled in the art can utilize known engineering practices to design and implement suitable systems with sufficient control to adjust the humidity to within the optimum humidity range to achieve optimum yield.

Referring to FIG. 10, adding water to the ash to increase its relative humidity to within the optimum humidity range, can be used if the relative humidity of the ash is too low. The air that is used for transport, for example by pneumatic conveying, or fluidizing can be humidified prior to contact with the ash. This can be accomplished by injection of water either as liquid or as steam. The mixing of steam (a gas) with air can be accomplished easily and rapidly by a simple injection port where the steam is injected into the flow of air and mixes with the air. The injection of liquid water is more difficult. The liquid water must be broken up into fine droplets so that it can mix rapidly with the ash. The state of the art in spraying devices is well described in a book entitled "Liquid Atomization" by L. Bayvel and Z. Orzechowski, published by Taylor & Francis, 1993, Library of Congress #93-8528, TP156.56L57. Particularly useful are pneumatic water atomizing devices because relatively large amounts of energy can be supplied as compressed air to produce fine droplets with high velocities which can mix rapidly.

The specific location of the humidity increasing devices 62, 64, 66, 68 will usually be determined by the layout of the plant and where water or steam are available. If the transport air is heated with steam, using steam injection will be very convenient, and reduces the possibility of injecting too much liquid water and having the process upset. This is particularly important if water is added to the fluidizing air either at the bottom of the silo via transport 50 or the bottom of the precipitator via transport 65. Too much water in the bottom of a flyash silo can cause agglomeration and even blockage of the silo. The amounts of water that are needed can be quite small.

Referring to FIG. 3, at 50 tons per hour, increasing the relative humidity of an ash from 5% to 10% for the case of the 13% LOI ash is an increase in moisture content from 0.04% to 0.06%, or an increase of 0.02% represents about 0.4 pounds per ton, or about 20 pounds per hour for a 50 ton per hour flow rate. Injection of liquid water can also be done to increase the relative humidity, but care must be taken to ensure that the water is dispersed throughout the ash. One way to do this is to inject the water with a pneumatic atomizer Model # 38972-2 from Delevan, 200 Delevan Drive, Lexington, Tenn. 38351 which uses compressed air to generate very fine droplets. This liquid water can also be injected at various places 62 and 64 in the ash transport system. Alternatively injecting the water at the injection point 68 below the feed storage silo or at the fluidizing point 66 in the bottom of the silo, is convenient because the ash relative humidity can be measured in the silo ahead of the water injection, and a controlled amount of water can be used. Also the screen and fluidizing feeder 56 can serve to produce mixing and disperse the water throughout the ash.

Water can also be injected into the compressor 38 used to compress the transport air, where the evaporative cooling of the air as it is being compressed will lower the compression energy slightly. Addition of water to or removal of water from the ash prior to the ash storage silo 36 can allow long residence times for water to migrate between particles. In this case the initial distribution of water on the ash need not be as uniform as when there is less elapsed time between water addition and separation.

Referring to FIG. 11, there are illustrated various embodiments for reduction of the flyash relative humidity to within the optimum humidity range. One apparatus used to reduce the heat loss encountered during flyash transport and handling through transport 42 is accomplished by insulating the transport 42 and the silo 36 with an insulation 76. In a typical power plant ash handling system the flyash leaves the electrostatic precipitator hopper 32 at greater than 150° F. If the ash is then transported long distances via the pneumatic conveying system (38, 40, 42), the ash can cool to near ambient temperature as heat is lost to the ambient environment. As the ash and associated air cools, the air can hold less water. When the ash and air are disengaged, at the silo 36, less water leaves with the air, and thus stays on the ash. Reducing the temperature drop of the ash in pneumatic transport lines between the precipitator hopper and the silo, such as by insulating the line, can aid in reducing the relative humidity of the ash as it enters the separator 12. Similarly since the saturation pressure of water at the precipitator temperature is quite high, displacing air in contact with the ash at the high temperature with dry air would remove much of the moisture. For example, by fluidizing the precipitator hopper 32 such as, for example, via the air transport system 61, 63, 65 with enough dry air to displace the flue gas from the ash before it is transported to the silo would remove the water from the ash-air system.

Having thus described several particular embodiments of the invention, various modifications and improvements will readily occur to those skilled in the art and are intended to be part of this disclosure. Accordingly, the foregoing description is by way of example only and is limited only as defined in the following claims and the equivalents thereto.

What is claimed is:

1. A method of separating carbon particles from flyash, comprising the steps of:

controlling a relative humidity of the flyash by one of increasing a relative humidity of the flyash and decreasing the relative humidity of the flyash to within an optimum relative humidity range to produce a treated flyash; and introducing the treated flyash into a triboelectric separator so as to triboelectrically charge the carbon particles and the flyash and electrostatically separate the charged carbon particles from the charged flyash.

2. The method of claim 1, wherein the optimum relative humidity range is from about 5% to 30%.

3. The method of claim 2, wherein the relative humidity of the flyash is reduced.

4. The method of claim 3, wherein the relative humidity of the flyash is decreased by heating air that is used to fluidize the flyash.

5. The method of claim 3, wherein the relative humidity of the flyash feed is decreased by the steps of:

combining the flyash with a reduced relative humidity air, in an ash-air transport system for transporting the ash to the separator, wherein the ash-air transport system is above an ambient temperature;

maintaining the ash-air transport system above the ambient temperature;

disengaging the air from the ash while the ash-air transport system is above the ambient temperature; and collecting the ash for feeding into the triboelectric separator.

6. The method of claim 5, wherein the relative humidity of the air is reduced by one of heating the air and dehumidifying the air to provide the reduced relative humidity air.

7. The method of claim 2, wherein the relative humidity of the flyash is increased.

8. The method of claim 7, wherein the relative humidity of the flyash is increased by adding water to air used to transport the flyash from a remote collection bin to the triboelectric separator.

9. The method of claim 8, wherein the water added is in a liquid state.

10. The method of claim 8, wherein the water added is in a vapor state.

11. The method of claim 7, wherein the relative humidity is increased by adding water to the flyash at a feed of the triboelectric separator.

12. The method of claim 11, wherein the water is added to the flyash prior to passage of the flyash through a fluidized region of the feed of the triboelectric separator.

13. The method of claim 1, wherein the flyash is a product of burning coal.

14. An apparatus for separating carbon particles from flyash, comprising:

flyash treating means for one of increasing a relative humidity of the flyash and decreasing the relative humidity of the flyash to within an optimum relative humidity range to produce a treated flyash; and a triboelectric separator that receives the treated flyash and that triboelectrically charges the carbon particles and the flyash so as to electrostatically separate the charged carbon particles from the charged flyash.

15. The apparatus as claimed in claim 14, wherein the flyash treating means includes a means for adding water to transport air, used to transport the flyash from a remote collection bin to the triboelectric separator.

16. The apparatus as claimed in claim 14, wherein the flyash treating includes a means for adding water to the flyash at a feed point of the triboelectric separator.

17. The apparatus as claimed in claim 14, wherein the flyash treating means includes a means for adding water to the flyash within an ash storage vessel feeding the triboelectric separator.

18. The apparatus as claimed in claim 14, wherein a transport air is used to transport the flyash from a remote collection bin to the triboelectric separator and the flyash treating means includes a heater that heats the transport air prior to combining the transport air with the flyash.

19. The apparatus as claimed in claim 18, wherein an air transport system, that transports the flyash from the remote collection bin to the triboelectric separator, is insulated so as to reduce heat loss of the transport air within the air transport system.

20. The apparatus as claimed in claim 19, further comprising an ash storage vessel at an end of the air transport system having an exit port that feeds the triboelectric separator.

21. The apparatus as claimed in claim 14, wherein the flyash treating means includes a heater that heats air, prior to combining the air with the flyash, used to fluidize the flyash.

22. The apparatus as claimed in claim 14, wherein the flyash treating means includes an apparatus for dehumidifying transport air, used to transport the flyash from a remote collection bin to the triboelectric separator, prior to combining the transport air with the flyash.

23. A utility power plant system, comprising:

a boiler for burning coal to produce heat used to generate electricity, the boiler producing non-combustible materials that exit the boiler in the form of gases;

an ash disengagement system, coupled to the boiler, that receives the gases exiting the boiler and collects the ash contained within the gases;

a flyash transport system, coupled to the ash disengagement system, that receives the collected ash and transports the collected ash to a remote storage vessel;

a flyash treating means for one of increasing a relative humidity of the flyash and decreasing the relative humidity of the flyash to within an optimum humidity range; and a triboelectric, counter current, belt separator that receives the flyash from the remote storage vessel and that triboelectrically charges carbon particles within the flyash as well as the flyash so as to electrostatically separate the charged carbon particles from the charged flyash.

* * * * *